US005806151A

United States Patent [19]

Uchiyama

[11] Patent Number: 5,806,151

[45] Date of Patent: Sep. 15, 1998

[54] LOCK SLIDER FOR SLIDE FASTENER

[75] Inventor: Seiji Uchiyama, Toyama-ken, Japan

[73] Assignee: YKK Corporation, Tokyo, Japan

[21] Appl. No.: 900,856

[22] Filed: Jul. 25, 1997

[30] Foreign Application Priority Data

Jul. 31, 1996 [JP] Japan ..... 8-201456

[51] Int. Cl.[6] ..... A44B 19/30

[52] U.S. Cl. ..... 24/418

[58] Field of Search ..... 24/418, 420, 421, 24/423, 424

[56] References Cited

U.S. PATENT DOCUMENTS

| | | |
|---|---|---|
| 2,172,214 | 9/1939 | Marinsky . |
| 2,172,217 | 9/1939 | Morin et al. . |
| 2,261,132 | 11/1941 | Poux . |
| 2,303,750 | 12/1942 | Marinsky . |
| 5,528,802 | 6/1996 | Akashi . |

FOREIGN PATENT DOCUMENTS

| | | |
|---|---|---|
| 0492403A | 1/1992 | European Pat. Off. . |
| 2291115 | 1/1996 | United Kingdom . |

*Primary Examiner*—James R. Brittain
*Attorney, Agent, or Firm*—Hill & Simpson

[57] ABSTRACT

A lock slider for slide fastener has on a slider body in a lock slider for slide fastener, an operating-lever-receiving seat is formed on a slider body. An operating lever has a grip at one end, and a locking pawl at an intermediate position off to the other end, which pawl is angularly spaced by 90° from the grip. With the lever, a resilient plate, an axle of a pull tab and attachment plate placed one over another in the seat, an axle of a pull tab placed over the resilient plate, the attachment plate is fixed to the seat in such a manner that the lever is angularly movable by about 90°. The grip is turned in such a manner that the resilient plate presses the cam so as to insert the locking pawl between the coupling elements to lock, and when the grip is raised, the locking pawl is retracted from between the coupling elements so that the slider can slide.

9 Claims, 10 Drawing Sheets

LOCK SLIDER FOR SLIDE FASTENER

BACKGROUND OF THE INVENTION

1. Field of the Invention

This invention relates to a lock slide fastener slider which has a simple operating mechanism to lock and unlock sliding of the slider of the slide fastener intentionally by manipulation and is particularly suitable for lock slide fasteners of garments to be worn by disabled persons such as suffering of, for example, dementia or senile dementia since it requires some power to unlock.

2. Description of the Related Art

U.S. Pat. No. 2,261,132 discloses a lock slide fastener slider which is locked and unlocked by pivotally moving a bail member by hand, which is equipped to a slider body.

In the known slider, the axle of a pull tab in the form of an elongate ring inserted at opposite ends into the slider body has a pair of locking pawls engageable with opposite coupling element rows in the coupling-element guide channel, and a cam is provided on the surface of the axle to be touchable with a leaf spring mounted in the slider body. If the pull tab is turned laterally, the cam raises the leaf spring. Then if the pull tab is turned to be flat completely, the locking pawl comes into engagement with the coupling elements. At that time, since the leaf spring is pressed against the flat surface of the cam to prevent the pull tab by its resiliency from turning, thus maintaining the locking pawl in engagement with the coupling elements. If the pull tab is turned to its upright posture against the resiliency of the leaf spring, the locking pawl is removed from the coupling elements so that the slider then is free to move along the opposed fastener stringers.

Various improvements have been proposed. For example, Japanese Patent Laid-Open Publication No. Hei 8-19407 discloses a lock slide fastener slider in which, as shown in FIG. 13 of the accompanying drawings, a rod-shaped operating lever 3' has a grip 19' projecting from one end, a locking pawl 21' projecting from an intermediate position by a right angle, and a cam 20' at a position different axially from the locking pawl 21'. The operating lever 3' is placed in an operating-lever-receiving seat 10' formed on the slider body 1', and a resilient plate 5' and the axle 24' of a pull tab 2' is placed over the operating lever 3', whereupon an attachment plate 4' is placed over these members accommodated in the seat 10'. The slider can be locked or unlocked by manually turning the operating lever.

However, according to the slider disclosed in the first-named publication, since the pull tab and the locking pawl are integral with each other so that the slider can be unlocked simply by raising the slider, it is impossible to prevent the slider fastener from unintended opening so that the slider cannot be used when it requires safety. Also this slider is not suitable for slider fasteners of garments to be worn by disabled persons who suffer dementia or senile dementia.

According to the slider of the second-named publication, the resilient plate 5', which is pressed against the operating lever 3' at opposite ends by the attachment plate 4', prevents the turning of the operating lever 3', and the cam 20' of the operating lever 3' merely serves to push the locking pawl 21'. Since the cam 20' thus does not serve to prevent turning of the operating lever 3', the slider would be locked non-stably and therefore might be easily unlocked when unintended.

SUMMARY OF THE INVENTION

It is therefore a first object of this invention to provide a lock slide fastener slider which is locked and unlocked not by operating a pull tab but by turning an operating lever under the resiliency of a resilient plate so that the operation can be done simply and smoothly.

A second object of the invention is to provide a lock slide fastener slider in which an operating lever can be held stably in a slider-locking position without inadvertently turning to a slider-unlocking position.

A third object of the invention is to provide a lock slide fastener slider in which an operating lever with a slider locking mechanism can be held stably on a slider body even when it is pivotally moved somehow and can be turned smoothly between a slider-locking position and a slider-unlocking position and in which a locking pawl can be inserted between a pair of rows of coupling elements right before coupling and which is suitable for a slide fastener having a pair of coupling element rows in the form of a coiled or zigzag-shape and of thermoplastic resin monofilament.

A fourth object of the invention is to provide a lock slide fastener slider in which a short-length operating lever can be turned smoothly by a small force and is suitable for a metal-type or injection-molded-type slide fastener having a pair of discrete metal or thermoplastic resin coupling elements.

A fifth object of the invention is to provide a lock slide fastener slider in which a locking pawl can be forced into one of a pair of uncoupled rows of coupling elements beyond the other coupling element row and cannot be easily released from the coupling elements and which is suitable for a slide fastener having a pair of coupling element rows made of a thermoplastic resin monofilament.

A sixth object of the invention is to provide a lock slide fastener slider in which a locking pawl can be inserted easily and reliably into a pair of coupled rows of coupling elements and cannot be easily released from the coupling elements and which is suitable for a slide fastener having a pair of rows of discrete metal or thermoplastic resin coupling elements.

A seventh object of the invention is to provide a lock slide fastener slider in which an operating lever accommodated in an operating-lever-receiving seat on a slider body can be turned simply to reliably bring a locking pawl into and out of engagement with a pair of rows of coupling elements right before coupling and in which locking and unlocking of the slider can be done reliably and which is suitable for a slide fastener having a pair of coupling element rows of a coiled thermoplastic resin monofilament.

An eighth object of the invention is to provide a lock slide fastener slider in which an operating lever accommodated in an operating-lever-receiving seat on a slider body can be turned simply to reliably bring a locking pawl into and out of engagement with a pair of rows of coupling elements right after coupling and in which locking and unlocking of the slider can be done reliably and which is suitable for a metal-type or injection-molded slide fastener having a pair of rows of discrete metal or thermoplastic resin coupling elements.

According to a first aspect of the invention, there is provided a lock slider for a slide fastener, comprising: a slider body composed of upper and lower wings joined at their front ends so as to define a coupling-element guide channel; an operating-lever-receiving seat extending on an upper surface of the upper wing; a rod-shaped operating lever rotatably received in the operating-lever-receiving seat and having a cam and a grip, both of which projects substantially perpendicularly from a circumferential surface of the operating lever; a pull tab having an axle placed on a resilient plate; and an attachment plate fixed to the operating-lever-receiving seat over the pull tab. The slider is characterized in that the operating lever further has a recess, which can receive an end of the resilient plate, between the cam and the grip in the same plane as the cam and a locking pawl projecting from the circumferential surface of the operating lever in a direction opposite to the cam; and the resilient plate is placed on the operating lever so as to define with the operating lever a pair of gaps one at each of opposite sides of the cam, with which the opposite ends of the resilient plate can be deformed downwardly;

According to a second aspect of the invention, the cam provided on the operating lever serving as a lock mechanism is disposed on the same side of the grip.

According to a third aspect of the invention, the cam and the locking pawl are disposed in an intermediate portion on the operating lever.

According to a fourth aspect of the invention, at least the cam of the cam and the locking pawl serving as a lock mechanism is disposed off to one end of the operating lever.

According to a fifth aspect of the invention, the locking pawl serving as a lock mechanism is disposed on a side opposite to the grip and in such a manner that, when the grip is turned about the axis of the operating lever to be substantially flat, the locking pawl projects into the coupling-element guide channel on its one side opposite to the side to which the grip falls flat.

According to a sixth aspect of the invention, the locking pawl and the grip serving as a locking mechanism are disposed perpendicularly to each other on the operating lever in such a manner that, when the grip is turned about the axis of the operating lever to be substantially flat, the locking pawl projects into the coupling-element guide channel at its one side opposite to the side to which the grip falls flat.

A seventh aspect of the invention, the locking pawl serving as a locking mechanism extends substantially perpendicularly from one surface of the grip in such a manner that, when the grip is turned about the axis of the operating lever to be substantially flat, the locking pawl projects into the coupling-element guide channel in the side to which the grip falls flat.

According to an eighth aspect of the invention, the operating-lever-receiving seat in the slider body has a longitudinal groove for receiving the operating lever, a cam-fitting portion disposed on one side of the groove, a locking-pawl-insertion hole disposed on the other side of the groove so as to communicate with the coupling-element guide channel, and a resilient-plate-supporting portion disposed in the groove adjacent to the cam-fitting portion for supporting the resilient plate. The resilient-plate-supporting portion may extend toward the front end and/or the rear end of the groove.

According to a ninth aspect of the invention, the operating-lever-receiving seat in the slider body has a longitudinal groove for receiving the operating lever, a cam-fitting portion disposed on one side of the groove, a resilient-plate-supporting portion disposed in the groove adjacent the cam-fitting portion, a grip-receiving recess disposed on the other side of the groove and extending substantially perpendicularly from a rear end of the groove, and a locking-pawl-insertion hole disposed centrally in the grip-receiving recess so as to communicate with the coupling-element guide channel.

DETAILED DESCRIPTION OF THE PREFERRED EMBODIMENTS

Preferred embodiments of a lock slide fastener slider according to this invention will now be described in detail with reference to the accompanying drawings.

Figure 1:
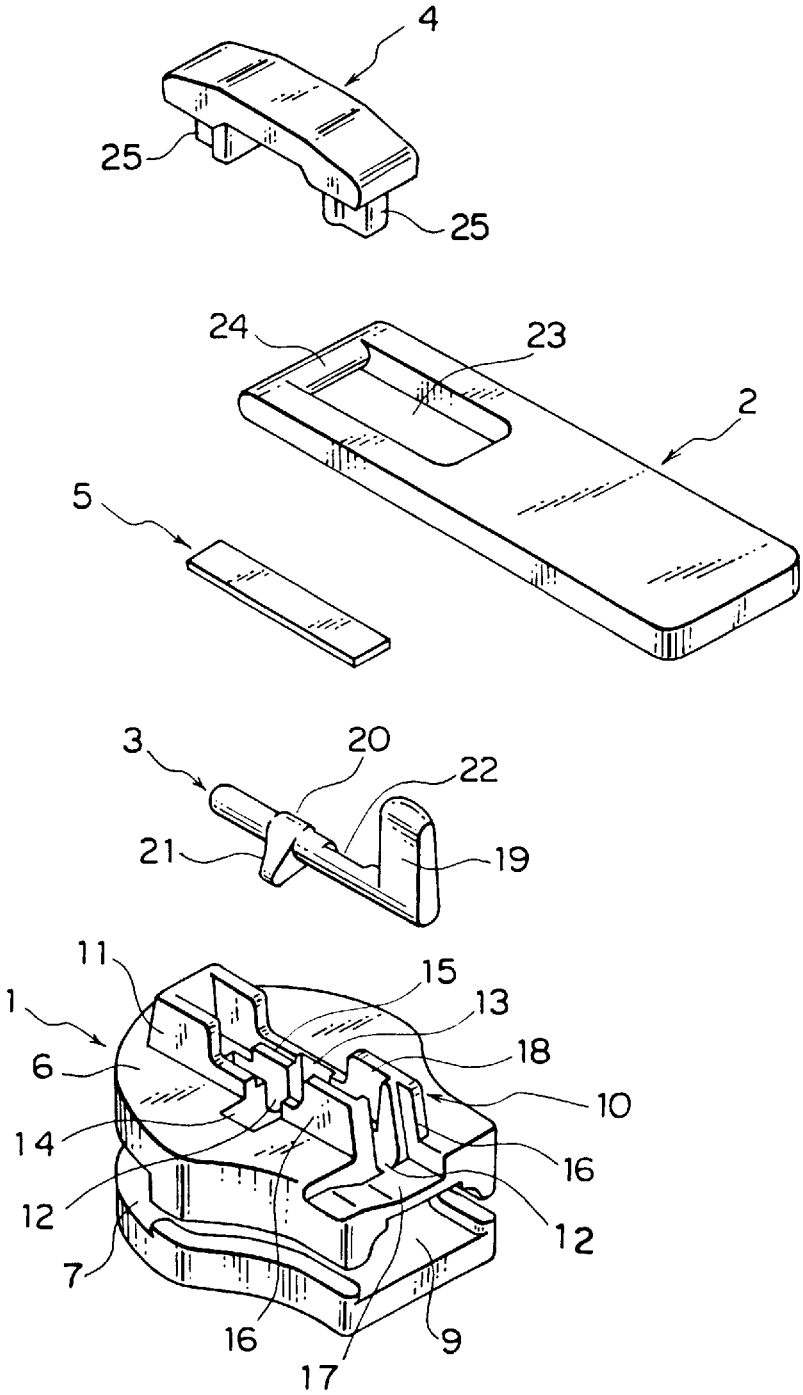
FIG. 1 is an exploded perspective view of a lock slide fastener slider according to a first embodiment of this invention.
Figure 2:
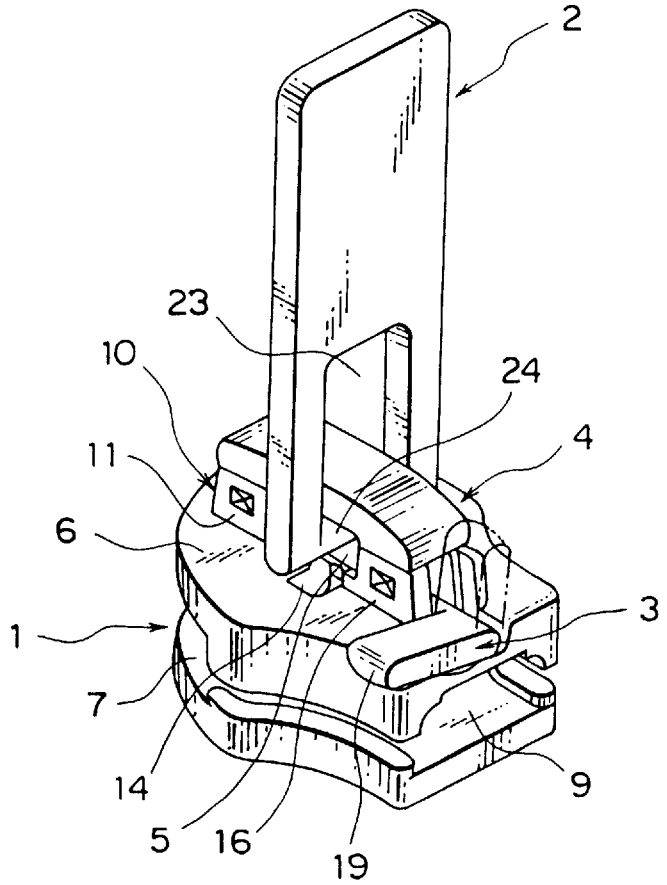
FIG. 2 is a perspective view of the slider of FIG. 1.
Figure 3:
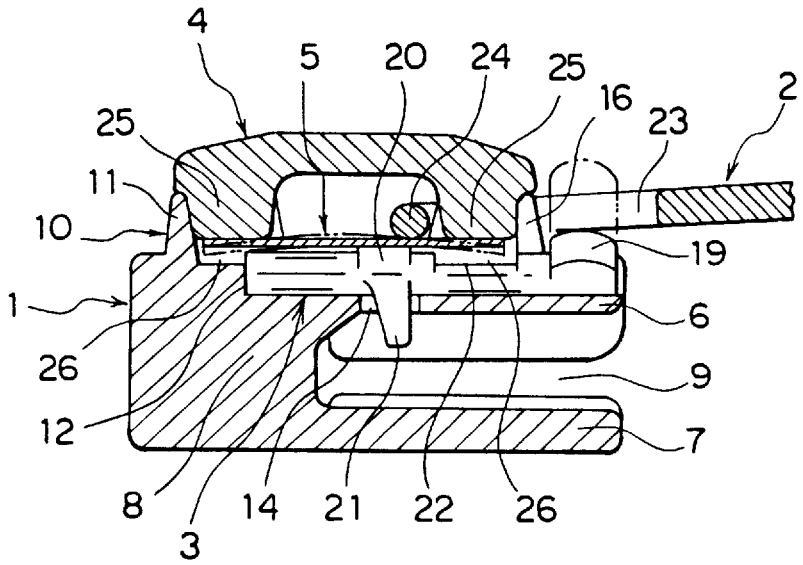
FIG. 3 is a longitudinal cross-sectional view of the slider of FIG. 2.
Figure 8:
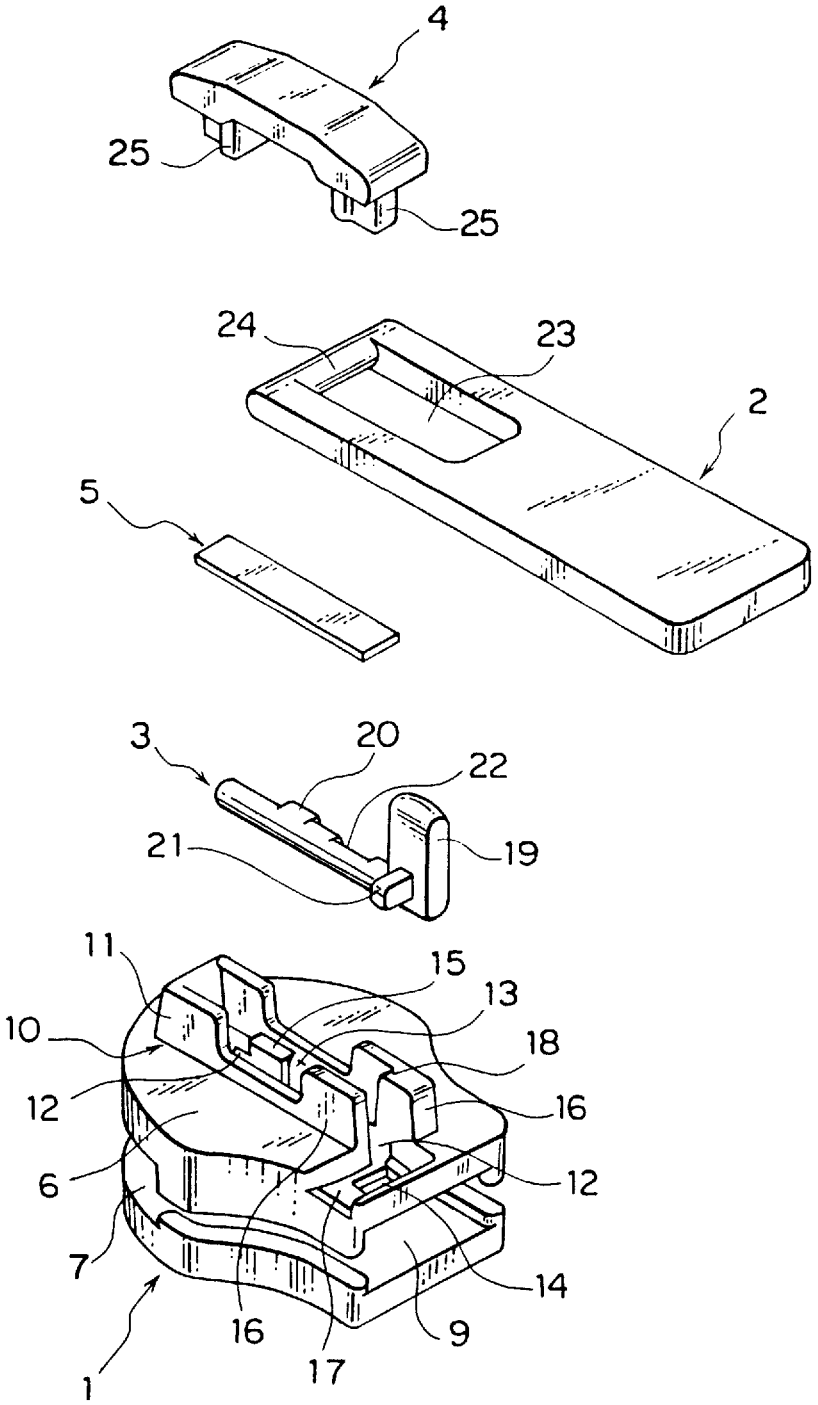
FIG. 8 is an exploded perspective view of a lock slide fastener slider according to a second embodiment of the invention.

As shown in FIG. 1 or 8, the lock slide fastener slider of this invention is a five-member structure composed of a slider body 1, a pull tab 2, an operating lever 3, an attachment plate 4 and a resilient plate 5. The slider body 1, the pull tab 2, and the operating lever 3 and the attachment plate 4 are preferably molded of metal such as aluminum alloy or a zinc alloy by die casting.

The slider body 1 of the lock slider of FIG. 1 is composed of upper and lower wings 6, 7 joined at their front ends by a central guide post 8 to define between the upper and lower wings 6, 7 a coupling-element guide channel 9. An operating-lever-receiving seat 10 is formed centrally on an upper surface of the upper wing 6 and extends longitudinally of the upper wing 6. The seat 10 has on its front side a generally C-shaped wall 11 in which one end of the resilient plate 5 is received and from which a longitudinal groove 12 extends to a rear end of the seat 10. The groove 12 has an arcuate bottom for turnably receiving the operating lever 3.

Further, the seat 10 has a cam-fitting portion 13 substantially centrally on one side of the groove 12 and a locking-pawl-insertion hole 14 on the other side of the groove 12, the locking-pawl-insertion hole 14 extending through the upper wing 6 to communicate with the coupling-element guide channel 9 so that the locking pawl 21 projecting from the operating lever 3 can move to the guide channel 9 in the slider body 1. Resilient-plate-supporting portions 15 extend from an intermediate position of the groove 12 near the cam-fitting portion 13 and the locking-pawl-insertion hole 14 toward a shoulder side; i.e. toward the C-shaped wall 11 for supporting part of the resilient plate 5, having a height above the uppermost surface of the operating lever 3 and a symmetrical shape.

The seat 10 has on its rear side a pair of opposite side walls 16. From the end of the side walls 16 toward the rear end of the slider 1, a grip-receiving recess 17 extends in the same direction as the locking-pawl-insertion hole 14 for receiving a flattened grip 19 of the operating lever 3 when the grip 19 is turned to be flat. The opposite side walls 16 have in their inner surfaces a side recess 18 equal in width to the C-shaped wall 11 for receiving the other end of the resilient plate 5.

Figure 4:
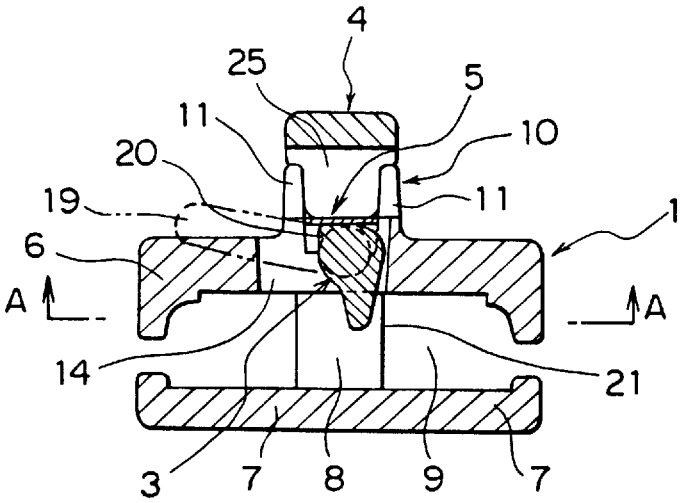
FIG. 4 is a transverse cross-sectional view of the slider of FIG. 2.

The operating lever 3 is in the form of a rod-shaped shaft having the grip 19 projecting substantially perpendicularly from one end, a cam 20 disposed at an intermediate position of the lever 3 and projecting by a right angle with respect to the grip 19, and a locking pawl 21 projecting from the intermediate position of the lever 3 in a direction opposite to the cam 20. The cam 20 has such a shape that, as shown in FIG. 4, a projection exists at a side the grip 19 projects, and the locking pawl 21 is provided to project at an opposite side of the grip 19. Between the cam 20 and the grip 19, a recess 22 is formed on the operating lever 3 on the same side as the cam 20 so that one end of the resilient plate 5 is not interfered with the operating lever 3 when the resilient plate 5 is resiliently deformed.

The pull tab 2 is in the form of a rectangular plate having an opening 23 off to one end so as to define an axle 24 at the end. The shape of the pull tab 2 should by no means be limited to this illustrated example, as long as it has the axle 24. The pull tab 2 may be in the form of a connector ring. The attachment plate 4 is in the form of a plate with at opposite ends a pair of T-cross-section legs 25 to be fitted in the C-shaped wall 11 and the recess 18 of the opposite side walls 16 provided on the upper surface of the slider body 1. One of the legs 25 is aligned with a gap 26 outside of the resilient plate-supporting portion 15, while the other leg 25 is aligned with the recess 22 of the operating lever 3. The resilient plate 5 is in the form of a rectangular leaf spring extending from the C-shaped wall 11 to the recess 18 of the opposite side walls 16.

For assembling the slider, firstly the operating lever 3 is placed in the operating-lever-receiving seat 10 on the upper wing 6 of the slider body 1 with the grip 19 received flat in the grip-receiving recess 17, with the cam 20 fitted in the cam-fitting portion 13 and with the locking pawl 21 inserted through the locking-pawl-insertion hole 14, then the resilient plate 5 is placed over the operating lever 3 and is supported on the resilient-plate-supporting portion 15, and then the axle 24 of the pull tab 2 is placed over the resilient plate 5. Finally, the legs 25 of the attachment plate 4 is fitted in the C-shaped wall 11 and the recess 18 of the opposite side walls 16 so as to touch the opposite ends of the resilient plate 5, and then the C-shaped wall 11 and the opposite side walls 16 are clenched to secure the legs 25 so as to form the gaps 26 under the opposite ends of the resilient plate 5.

Figure 5:
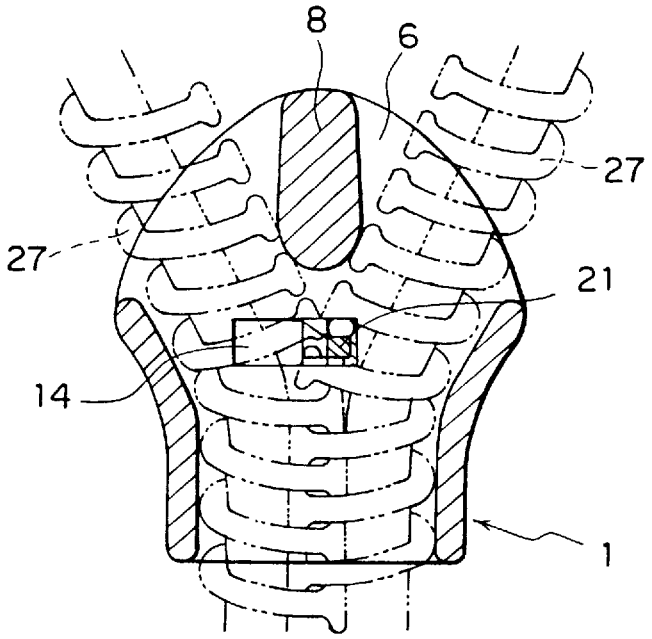
FIG. 5 is a cross-sectional view taken along line A—A of FIG. 4, showing the slider threaded on a pair of opposed fastener stringers.

The above-described lock slider is suitable for a slide fastener having on their inner edges of opposite fastener tapes a pair of rows of coiled- or zigzag-type coupling elements 27 of thermoplastic resin monofilaments, such as shown in FIG. 5.

In operation, if the grip 19 of the operating lever 3 is turned to an upright posture, the locking pawl 21 is retracted from the coupling-elements 27 so that the slider is free to slide by pulling the pull tab 2. During this sliding, partly since the operating lever 3 is resiliently pressed by the resilient plate 5 and partly because of the presence of cam 20 and the locking pawl 21, the operating lever 3 is prevented from being inadvertently turned.

When the grip 19 of the locking lever 3 is turned flat toward the grip-receiving recess 17, the locking pawl 21 is brought beyond the other rows of coupling elements 27 on the same side as the coupling-element-insertion hole 14 into engagement with one of opposite rows of coupling elements 27 right before coupling in the guide channel 9 of the slider 1. In order to remove the inserted locking pawl 21 from the row of coupling elements 27, the locking pawl 21 must press and pass the former coupling element row 27.

Further, since resilient plate 5 is pressed against the cam 20 provided in the operating lever 3 and having an irregular surface, the operating lever 3 cannot normally be turned while being locked. Therefore, the slider cannot be moved off the locked state unless the grip 19 of the operating lever 3 is intentionally turned to the upright posture. Since the operating lever 3 itself floats against the bias of the resilient plate 5 when the locking pawl 21 passes over the coupling element 27, the locking pawl 21 can pass over the coupling element 27 easily.

Figure 6:
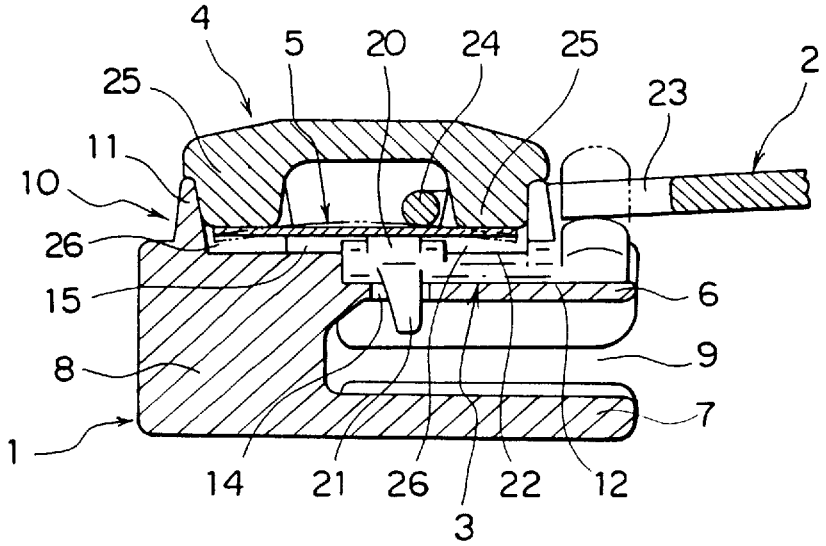
FIG. 6 is a longitudinal cross-sectional view showing a modification of the slider of the first embodiment.

FIG. 6 shows a modification of the slider of the first embodiment. This modification is identical in construction with the first embodiment except that the front part of the locking lever 3 is cut off in such a manner that the cam 20 and the locking pawl 21 are disposed at the front end of the operating lever 3 and the operating lever 3 is formed to be short.

Figure 7:
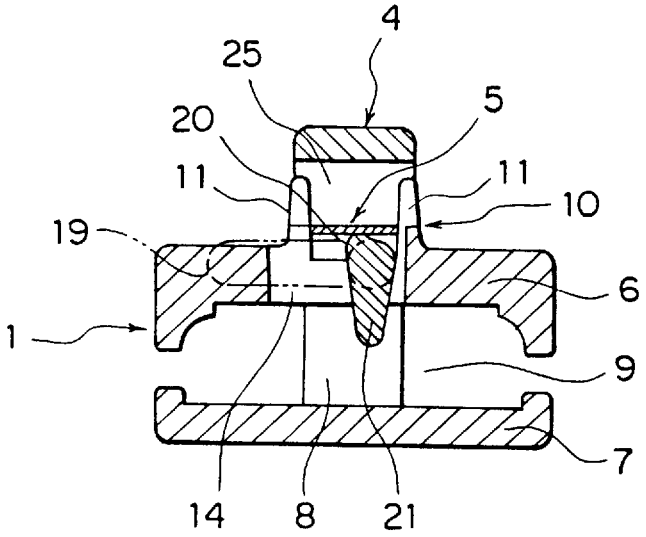
FIG. 7 is a transverse cross-sectional view showing another modification of the slider of the first embodiment.

FIG. 7 shows another modification of the slider of the first embodiment. This modification is identical in construction with the first embodiment except that the grip 19 and the locking pawl 21 of the operating lever 3 are disposed perpendicularly with each other, with the cam 20 disposed off to the grip 19, that the groove 12 in which the operating lever 3 is received is disposed off to one side of the seat 10 provided in the upper wing 6 of the slider body 1, i.e., opposite to the side on which the grip 19 is turned to be flat, and that the resilient-plate-supporting portion 15 is disposed only on the side on which the grip 19 is turned to be flat so that the locking pawl 21 can project into the coupling-element guide channel 9 opposite to the side which the grip 19 falls flat. As can be seen in FIG. 7, the cam 20 projects from the operating lever 3 in a direction at an angle less than 90° with respect to a direction in which the grip 19 projects from the operating lever 3.

Figure 9:
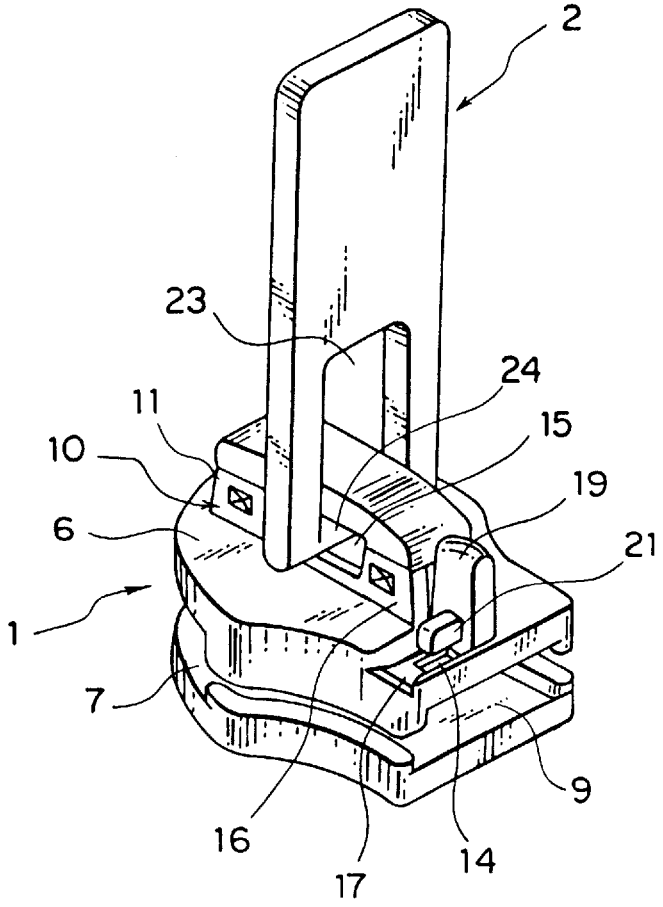
FIG. 9 is a perspective view of the slider of FIG. 8.
Figure 10:
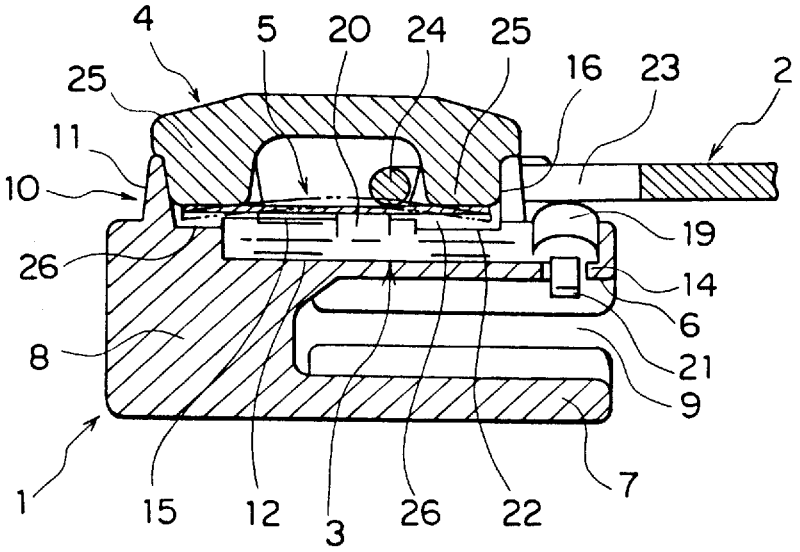
FIG. 10 is a longitudinal cross-sectional view of the slider of FIG. 9.
Figure 11:
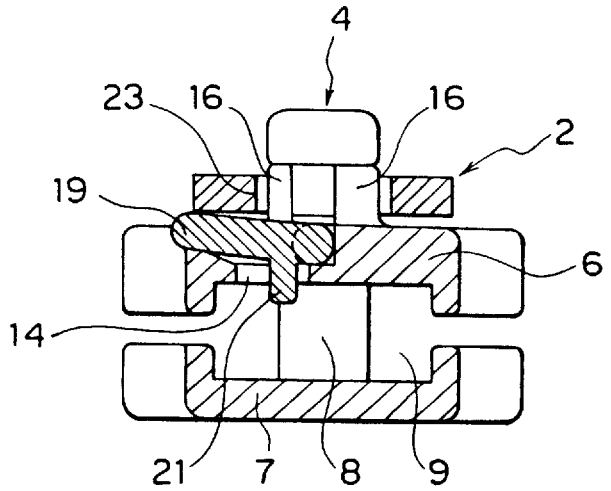
FIG. 11 is a transverse cross-sectional view of the slider of FIG. 9.

FIGS. 8, 9 and 10 show a lock slide fastener slider of a second embodiment of the invention. The slider of the second embodiment, like the first embodiment, has a five-member structure composed of a slider body 1, a pull tab 2, an operating lever 3, an attachment plate 4 and a resilient plate 5. An operating-lever-receiving seat 10 is formed centrally on an upper surface of the upper wing 6 of the slider body 1 and extends longitudinally of the upper wing 6. The seat 10 has on its shoulder side, i.e. front side a generally C-shaped wall 11 in which one end of the resilient plate 5 is received and from which a longitudinal groove 12 extends to a rear end of the seat 10. The seat 10 has on its rear side a pair of opposite side walls 16. The opposite side walls 16 have in their inner surfaces a side recess 18 equal in width to the C-shaped wall 11 for receiving the other end of the resilient plate 5. The groove 12 is provided off to one side, from the C-shaped wall 11 to the side walls 16 for receiving the operating lever 3 and has an arcuate bottom for turnably receiving the operating lever 3.

Further, a resilient-plate-supporting portion 15 for supporting the resilient plate 5 is provided on one side of the groove 12, and a cam-fitting portion 13 is provided contiguous to the resilient-plate-supporting portion 15. At the rear end of the groove 12, a grip-receiving recess 17 extends in a direction opposite to the cam-fitting portion 13 for receiving a flattened grip 19 of the operating lever 3 when the grip 19 is turned to be flat. A locking pawl 21 projects from one surface of the base of the grip 19. A locking-pawl-insertion hole 14 is disposed centrally in the bottom of the grip-receiving recess 17 and extends between the grip-receiving recess 17 and a coupling-element guide channel 9. When the grip 19 is turned against the grip-receiving recess 17 to assume a horizontal posture, the locking pawl 21 is brought into the coupling-element guide channel 9 to engage one of opposite coupling element rows after coupling.

The groove 12 extends on the upper surface of the upper wing 6 leaving part of the front side bottom surrounded by the C-shaped walls 11 and part of the rear side bottom between the opposite side walls 16. The resilient-plate-supporting portion 15 provided on one side of the groove 12 has a height above the level of the uppermost surface of the operating lever 3.

The operating lever 3 has the grip 19 at one end and a cam 20 disposed at an intermediate position and projecting at substantially a right angle with respect to the grip 19. A locking pawl 21 projects from one surface of the grip 19, i.e. in a direction opposite to the projecting direction of the cam 20. These three members are provided to be substantially perpendicular to the axis of the operating lever 3. Between the cam 20 and the grip 19, a recess 22 is formed on the operating lever 3 on the same side as the cam 20 so that one end of the resilient plate 5 is not interfered with the operating lever 3 when the resilient plate 5 is resiliently deformed.

The pull tab 2 is in the form of a rectangular plate having an opening 23 off to one end so as to define an axle 24 at the end. The shape of the pull tab 2 should by no means be limited to this illustrated example, as long as it has the axle 24. The pull tab 2 may be in the form of a connector ring. The attachment plate 4 is in the form of a plate with at opposite ends a pair of T-cross-section legs 25 to be fitted in the C-shaped wall 11 and the recess 18 of the opposite side walls 16 provided on the upper surface of the slider body 1. One of the legs 25 is aligned with a gap 26 outside of the resilient plate-supporting portion 15, while the other leg 25 is aligned with the recess 22 of the operating lever 3. The resilient plate 5 of this embodiment, like the first embodiment, is in the form of a rectangular leaf spring extending from the C-shaped wall 11 to the recess 18 of the opposite side walls 16.

For assembling the slider, firstly the operating lever 3 is placed in the groove 12 in the operating-lever-receiving seat 10 on the upper wing 6 of the slider body 1 with the grip 19 received in horizontal posture in the grip-receiving recess 17, with the cam 20 corresponding to the cam-fitting portion 13 and with the locking pawl 21 corresponding to the locking-pawl-insertion hole 14 in the grip-receiving recess 17, then the resilient plate 5 is placed over the operating lever 3 and is supported on the resilient-plate-supporting portion 15 between the C-shaped wall 11 and the recess 18 of the opposite side walls 16, and then the axle 24 of the pull tab 2 is placed over the resilient plate 5. Finally, each of the legs 25 of the attachment plate 4 is fitted in the C-shaped wall 11 and the recess 18 of the opposite side walls 16 respectively so as to touch the opposite ends of the resilient plate 5, and then the C-shaped wall 11 and the opposite side walls 16 are clenched to secure the legs 25 so as to form the gaps 26 under the opposite ends of the resilient plate 5.

The above-described lock slider is suitable for a slide fastener having on their inner edges of opposite fastener tapes a pair of rows of discrete metal coupling elements or thermoplastic resin injection-molded coupling elements.

In operation, if the grip 19 of the operating lever 3 is turned to an upright posture, the locking pawl 21 is retracted from between coupling elements 27 in the coupling-element guide channel 9 and also from the locking-pawl-insertion hole 14 in the grip-receiving recess 17, and simultaneously the cam 20 is fitted in the cam-fitting portion 13 so that the slider is free to slide on the opposed coupling element rows 27. During this sliding, partly since the operating lever 3 is resiliently pressed by the resilient plate 5 and partly because of the presence of cam 20 and the locking pawl 21, the operating lever 3 is prevented from being inadvertently turned. In order to lock the slider, the grip 19 is turned to be flat on the grip-receiving recess 17 and the locking pawl 21 is inserted between the coupling elements 27 in the coupling-element guide channel 9.

At the time of locking, the locking pawl 21 is brought into engagement with one side of opposite coupling elements 27 right after coupling. In case that a distal end of the locking pawl 21 contacts a front surface of the coupling element 27, since the operating lever 3 itself floats against the bias of the resilient plate 5, and due to the forward and backward fine movements of the slider body 1, the locking pawl 21 can be inserted between coupled coupling elements 27 so that the slider gets locked.

Figure 12:
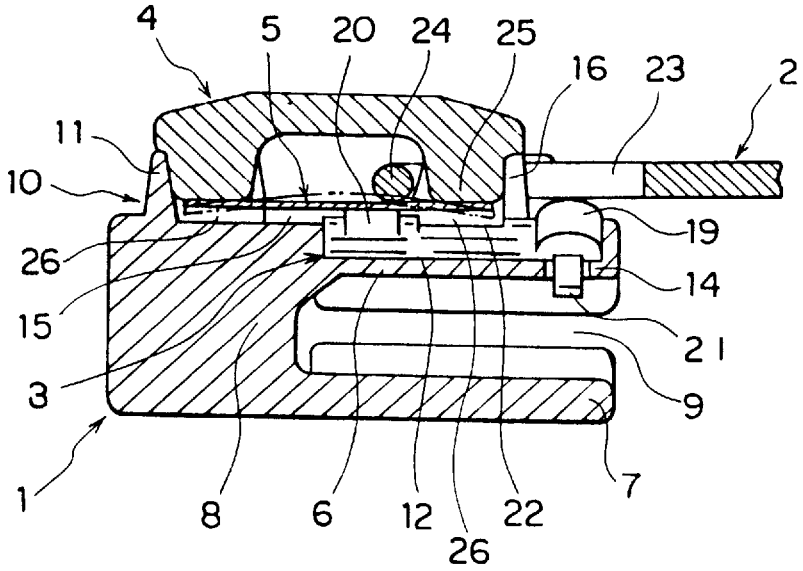
FIG. 12 is a longitudinal cross-sectional view showing a modification of the slider of the second embodiment.
Figure 13:
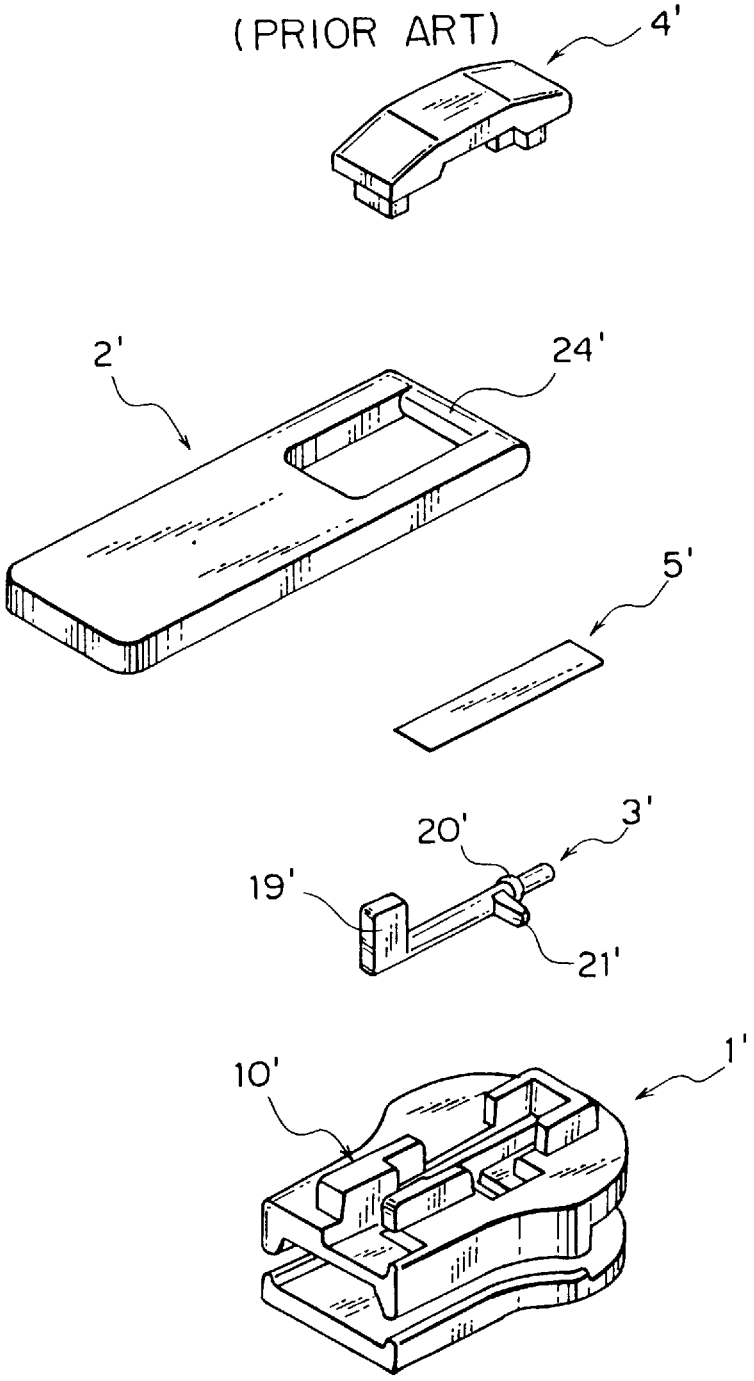
FIG. 13 (PRIOR ART)
FIG. 13 is an exploded perspective view of a conventional lock slide fastener slider.

FIG. 12 shows a modification of the lock slider for slide fastener of the second embodiment. This modification is identical in construction with the second embodiment except that the front part of the operating lever 3 is cut off to be short in such a manner that the cam 20 is disposed at the end of the short operating lever 3.

The thus constructed lock slide fastener slider of this invention has above-described features which realize the following advantageous results:

According to the slider of the first aspect of this invention, partly since the cam 20 and the grip 19 are angularly spaced by approximately a right angle about the axis of the operating lever 3, partly since the recess 22 is formed in the operating lever 3 between the cam 20 and the grip 19 in the same plane as the cam surface, partly since the operating lever 3 having the locking pawl 21 on the side opposite to the cam 20 is turnably accommodated in the operating-lever-receiving seat 10 in the slider body 1, and partly since the resilient plate 5 is placed over the operating lever 3 so as to form the pair of resilient-plate-deforming gaps 26 under its opposite ends, the resilient plate 5 can deform without interference with the operating lever 3 so that the operating lever 3 is free to float, thus facilitating turning the operating lever 3 between the slider-locking position and the slider-unlocking position. If the locking pawl 21 has once been locked, the operating lever 3 can maintain its locked state by the action of the resilient plate 5.

According to the slider of the second aspect of the invention, since the cam 20 is formed on the operating lever 3 off to the grip 19, it is possible to simply prevent the operating lever 3 from being inadvertently turned to the slider-unlocking position. The stably locked state of the slider is maintained unless the grip 19 is intentionally turned to an upright posture.

According to the slider of the third aspect of the invention, since the cam 20 and the locking pawl 21 are disposed at an intermediate position of the operating lever 3, it is possible to hold the operating lever 3 in a very stable manner so that the operation lever can be turned reliably and smoothly. Further, since the cam and locking pawl are disposed on opposite sides of the locking lever, the locking lever in locked position can be maintained reliably by the pressing force of the resilient plate effectively due to the cam 20.

According to the slider of the fourth aspect of the invention, since at least the cam 20 of the cam 20 and the locking pawl 21 is disposed at the front end of the operating lever 3, the operating lever can be turned smoothly with no large force, and the operating lever 3 may be short which enables smooth operation. This form is suitable for a large-sized slider and hence particularly useful when used in a slide fastener in which the locking pawl 21 is inserted between discrete coupling elements 27 right after coupling, so as to fully perform locking function.

According to the slider of the fifth aspect of the invention, since the locking pawl 21 is disposed on a side opposite to the grip 19 so that the locking pawl 21 is provided in the slider body 1 so as to project into and retract from the coupling-element guide channel 9 remote from the side on which the grip 19 is turned to be flat. Therefore, the locking pawl 21 can be brought into engagement with the remote-side row of coupling elements beyond the near-side row of coupling elements simply right before these coupling elements are coupled, thus maintaining the slider firmly in the locked state with no inadvertent release. This slider is particularly suitable for a slide fastener having a pair of coupling element rows each of thermoplastic resin monofilament.

According to the slider of the sixth aspect of the invention, since the locking pawl 21 and the grip 19 are disposed at substantially a right angle with each other about the axis of the operating lever in such a manner that the locking pawl 21 can project into the coupling-element guide channel 9 remote from the side on which the grip is turned to be flat, the locking pawl can be brought into the remote-side row of coupling elements 27 beyond the near-side row of coupling elements 27 before these coupling elements 27 are coupled, thus maintaining the slider firmly in the locked state with no inadvertent release. This slider is particularly suitable for a slide fastener having rows of coupling elements of thermoplastic resin monofilaments.

According to the slider of the seventh aspect of the invention, since the locking pawl 21 projects substantially perpendicularly from the side of the grip 19 toward which the grip 19 falls in such a manner that the locking pawl 21 can project into the coupling-element guide channel 9 on the side the grip 19 falls flat, it is possible to bring the locking pawl 21 reliably and easily into engagement with the near-side row of coupling elements 27 in the coupled pair of coupling element rows with the simple construction, thus maintaining the slider firmly in the locked state. This slider is particularly suitable for a slide fastener having a pair of rows of discrete metal or thermoplastic resin coupling elements.

According to the slider of the eighth aspect of the invention, since the operating-lever-receiving seat 10 has the longitudinal groove 12 on the slider body 1 for receiving the operating lever 3, the cam-fitting portion 13 on one side of the groove 12, the locking-pawl-insertion hole 14 on the other side of the groove 12, the resilient-plate-supporting portion 15 disposed on opposite sides of the groove 12 and extending from near the cam-fitting portion 13 toward the front for supporting the resilient plate 5, it is possible to hold the operating lever 3 stably in the seat 10 and the resilient plate 5 can act reliably so that adequate locking function can be achieved. Further, the slider in which the locking pawl 21 can pass over one side row of coupling elements 27 of a thermoplastic resin monofilament, and can come into engagement with the other side row of coupling elements 27 right before these coupling elements 27 are coupled can be easily manufactured.

According to the slider of the ninth aspect of the invention, since the operating-lever-receiving seat 10 has the central groove 12 extending longitudinally of the slider body 1 for receiving the operating lever 3, the cam-fitting portion 13 disposed on one side of the groove 12, the resilient-plate-supporting portion 15 disposed at a part of the groove 12 on the cam-fitting portion side and extending from the cam-fitting portion 13 toward the front, the grip-receiving recess 17 projecting from the rear end of the groove 12 in the direction opposite to the cam-fitting portion 13, and the locking-pawl-insertion hole 14 disposed centrally in the grip-receiving recess, it is possible to hold the operating lever 3 stably in the seat 10 in the slider body 1 and the resilient plate 5 can act reliably so that adequate locking function can be achieved. Further, the slider in which the locking pawl 21 can be inserted between the discrete coupling elements 27 of metal or thermoplastic resin right after coupling can be easily manufactured.

What is claimed is:

1. A lock slider for a slide fastener, comprising:

(a) a slider body composed of upper and lower wings joined at their front ends so as to define a coupling-element guide channel;

(b) an operating-lever-receiving seat extending on an upper surface of said upper wing;

(c) a rod-shaped operating lever rotatably received in said operating-lever-receiving seat and having a cam and a grip, both of which projects substantially perpendicularly from a circumferential surface of said operating lever, said operating lever further having a recess between said cam and said grip in the same plane as said cam and a locking pawl projecting from the circumferential surface of said operating lever in a direction opposite to said cam;

(d) a resilient plate placed on said operating lever so as to define with said operating lever a pair of gaps one at each of opposite sides of said cam;

(e) a pull tab having an axle placed on said resilient plate; and (f) an attachment plate fixed to said operating-lever-receiving seat over said pull tab.

2. A lock slider according to claim 1, wherein said cam provided on said operating lever projects from said operating lever in a direction at an angle less than 90° with respect to a direction in which said grip projects.

3. A lock slider according to claim 1, wherein said cam and said locking pawl are disposed in an intermediate portion on said operating lever.

4. A lock slider according to claim 1, wherein at least said cam or said cam and said locking pawl is disposed off to one end of said operating lever.

5. A lock slider according to claim 1, wherein said locking pawl is disposed on a side opposite to said grip in such a manner that, when said grip is turned about the axis of said operating lever to be substantially flat, said locking pawl projects into said coupling-element guide channel on its one side opposite to the side to which said grip falls flat.

6. A lock slider according to claim 1, wherein said locking pawl and said grip are disposed perpendicularly to each other on said operating lever in such a manner that, when said grip is turned about the axis of said operating lever to be substantially flat, said locking pawl projects into said coupling-element guide channel at its one side opposite to the side to which said grip falls flat.

7. A lock slider according to claim 1, wherein said locking pawl extends substantially perpendicularly from one surface of said grip in such a manner that, when said grip is turned about the axis of said operating lever to be substantially flat, said locking pawl projects into said coupling-element guide channel in the side to which said grip falls flat.

8. A lock slider according to claim 1, wherein said operating-lever-receiving seat in the slider body has a longitudinal groove for receiving said operating lever, a cam-fitting portion disposed on one side of said groove, a locking-pawl-insertion hole disposed on the other side of said groove, and a resilient-plate-supporting portion disposed in said groove adjacent said cam-fitting portion for supporting said resilient plate.

9. A lock slider according to claim 1, wherein said operating-lever-receiving seat in the slider body has a longitudinal groove for receiving said operating lever, a cam-fitting portion disposed on one side of said groove, a resilient-plate-supporting portion disposed in said groove adjacent said cam-fitting portion, a grip-receiving recess disposed on the other side of said groove and extending substantially perpendicularly from a rear end of said groove, and a locking-pawl-insertion hole disposed centrally in said grip-receiving recess.

* * * * *